US006631814B2

(12) United States Patent
Willim

(10) Patent No.: US 6,631,814 B2
(45) Date of Patent: Oct. 14, 2003

(54) CRANE VEHICLE

(75) Inventor: Hans-Dieter Willim, Ulm (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 15 days.

(21) Appl. No.: 09/791,283

(22) Filed: Feb. 23, 2001

(65) Prior Publication Data

US 2001/0027955 A1 Oct. 11, 2001

(30) Foreign Application Priority Data

Feb. 25, 2000 (DE) ..... 200 03 490 U

(51) Int. Cl.[7] ..... B66C 23/74
(52) U.S. Cl. ..... 212/178; 212/195
(58) Field of Search ..... 212/278, 195, 212/196

(56) References Cited

U.S. PATENT DOCUMENTS

| | | | | |
|---|---|---|---|---|
| 1,497,686 A | | 6/1924 | Johnson | |
| 4,258,852 A | * | 3/1981 | Juergens | 212/178 |
| 4,363,412 A | | 12/1982 | Patel et al. | |
| 4,483,448 A | * | 11/1984 | Wittman et al. | 212/189 |
| 5,615,784 A | * | 4/1997 | Pech et al. | 212/178 |

FOREIGN PATENT DOCUMENTS

| | | | |
|---|---|---|---|
| DE | 2202381 | | 8/1972 |
| DE | 34 03 419 | * | 8/1985 |
| DE | 198 14 636 | * | 9/1999 |
| EP | 856486 | * | 1/1998 |
| WO | 94/21549 | | 9/1994 |

* cited by examiner

*Primary Examiner*—Thomas J. Brahan
(74) *Attorney, Agent, or Firm*—Dilworth & Barrese, LLP.

(57) ABSTRACT

A crane vehicle is provided with a carrier and a rotating deck pivotable around a vertical axis thereon on which a boom swivellable around a horizontal axis is supported. Pallets are mounted at the projecting outer end of the rotating desk at both sides to receive counterweight slabs stacked on top of one another. To produce a greater balancing counter-moment to the boom and the load suspended thereon without putting on additional counterweight slabs, a frame can be attached to the outer end of the rotating deck, said frame being provided with accommodations or couplings at least for the respective rear suspension points of the pallets.

11 Claims, 5 Drawing Sheets

CRANE VEHICLE

BACKGROUND OF THE INVENTION

The invention relates to a crane vehicle having a carrier and a rotating deck pivotable around a vertical axis thereon on which a boom swivellable around a horizontal axis is supported and at whose projecting, outer end pallets are mounted at both sides to receive counterweight slabs stacked on top of one another. In this crane vehicle, the projecting outer end of the rotating deck forms a counter-boom, so to speak, at which the counterweight is mounted to balance the boom and the load suspended thereon. If a larger counterweight is required to balance the boom and the load carried thereby, further counterweight slabs are normally placed on the stacked counterweight slabs. This is, however, relatively expensive because the additional counterweight slabs have to be transported and kept available.

SUMMARY OF THE INVENTION

It is therefore the object of the invention to produce a greater balancing counter-moment in a crane vehicle of the kind first mentioned without placing on additional counterweight slabs.

This object is solved in accordance with the invention by a frame being attachable to the outer end of the rotating deck, said frame being provided with accommodations or couplings at least for the respective rear suspension points of the pallets.

In the crane vehicle in accordance with the invention, the balancing moment is increased by the lever arm, at which the counterweight acts, being extended. This is achieved by the pallets supporting the stacked counterweight slabs being offset to the rear with respect to the rotating deck.

The frame extending the rotating deck to the rear can accept in each case one suspension point of the pallets or, however, also all suspension points of the pallets.

The suspension points can consist of bolt connections or hook connections.

A simple attachment of the pallets extending the lever arm is possible by the pallets being connectable by suspension devices situated at their side parts to counter-accommodations of the rotating deck and by the inner suspension devices of the pallets being able to be coupled to the outer counter-accommodations when the frame is attached. The inner suspension points of the pallets can in this way be coupled to the already present end counter-accommodations of the rotating deck so that the attached frame then only has to be provided with counter-accommodations for the outer suspension points of the pallets.

It is provided in accordance with another embodiment that the frame is provided with two accommodations or couplings for in each case two side suspension points of the pallet.

The suspension points can consist of bolt connections or hook connections.

The pallets are appropriately able to be coupled in the same manner to both the rotating deck and the frame which can be attached thereto. The pallets are therefore able to be coupled to counter-accommodations of the rotating deck by bolt or hook connections located at the side parts of said pallets, with the inner bolts or hook connections of the pallets being able to be coupled to the outer counter-accommodations of the rotating deck when the frame is attached.

It is provided in accordance with another aspect that the two pallets are connected to one another by a central intermediate piece connectable to the frame. In this embodiment, the side pallets are connected by the central intermediate piece to form a continuous slab or carrier, so to speak, whose central region is connected to the frame so that the parts of the carrier projecting over the frame at the side form the pallet-like accommodations for the counterweight slabs.

It can be appropriate in certain operating states to design the value of the stabilizing counter-moment variably. In accordance with another embodiment, it is therefore provided for the counterweight slabs to be displaceable with the positioned counterweight slabs on guides of the rotating deck. The lever arm, at which the counterweight acts, can therefore be adjusted to the different load cases by a corresponding displacement of the trolleys or slides bearing the counterweight slabs, for example by hydraulic cylinders.

BRIEF DESCRIPTION OF THE DRAWINGS

An embodiment of the invention is described in more detail below with reference to the drawings in which.

DESCRIPTION OF THE PREFERRED EMBODIMENTS

The revolving superstructure or rotating deck 1 is pivoted via a pivot bearing (not shown) around the vertical axis of rotation 2 on a self-propelled carrier (not shown). The rotating deck 1 is provided with a rotary drive of which only the toothed turntable 3 is shown. The rotating deck is provided at its front end with bearings 4 in which the boom is pivoted on a horizontal axis of swivel.

Winches and drive units are mounted in the rotating deck 1 in the normal manner.

Figure 5:
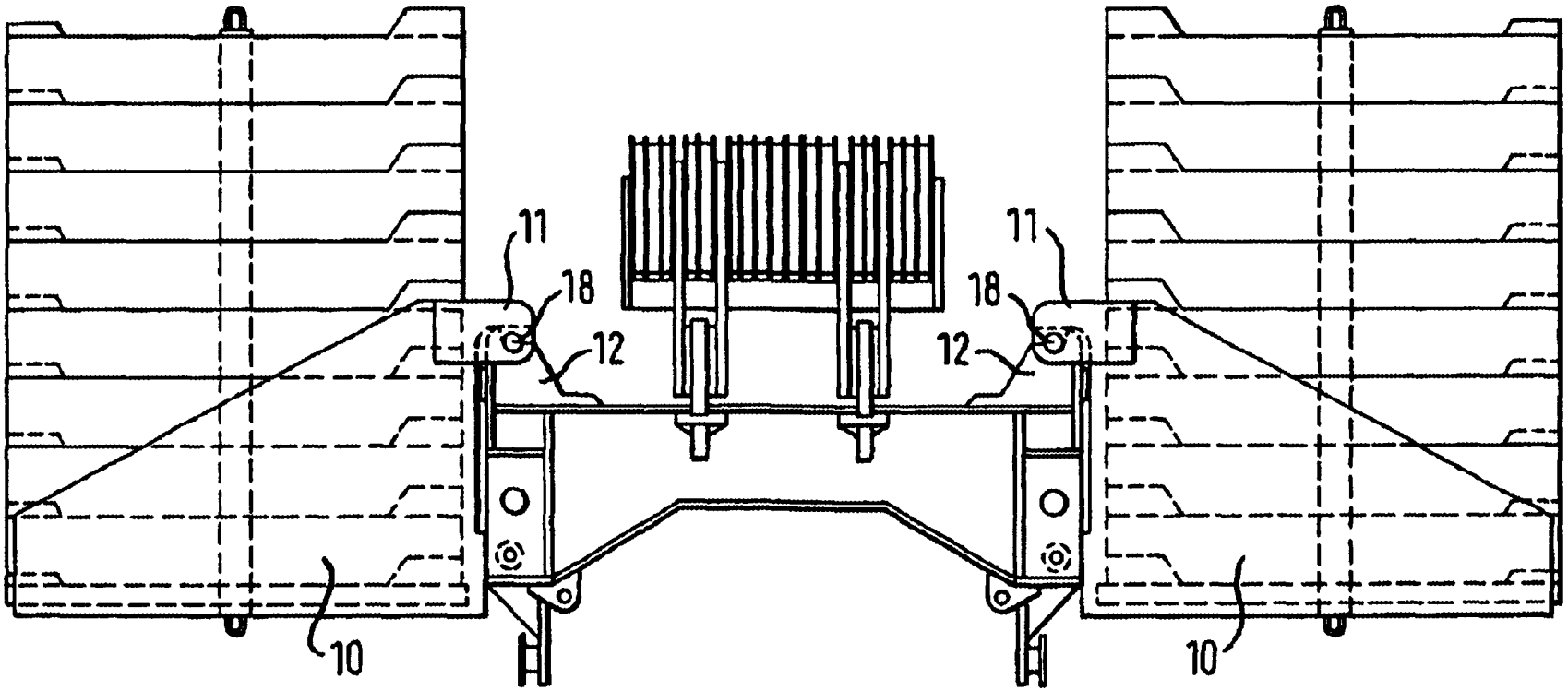
FIG. 5 shows a rear view of the rotating deck in accordance with FIG. 1.

At the rear end 5 of the rotating deck, pallets 6,7 are mounted at its sides and counterweight slabs 8 are stacked on said pallets 6,7. The ground slabs of the pallets 6,7 are borne in the manner visible from FIG. 5 by front or side walls 9, 10 which are provided at their upper inner ends with projecting fork-like shackles 11 which are connected to one another in the region of their outer ends by transverse bolts 18 to form hook-like eyes which can be hooked to uprising counter-hooks 12 which are arranged at the side of the rotating deck 1. The floor regions of the pallets can be supported in the manner shown on side parts of the rotating deck or of the frame attached thereto.

Figure 1:
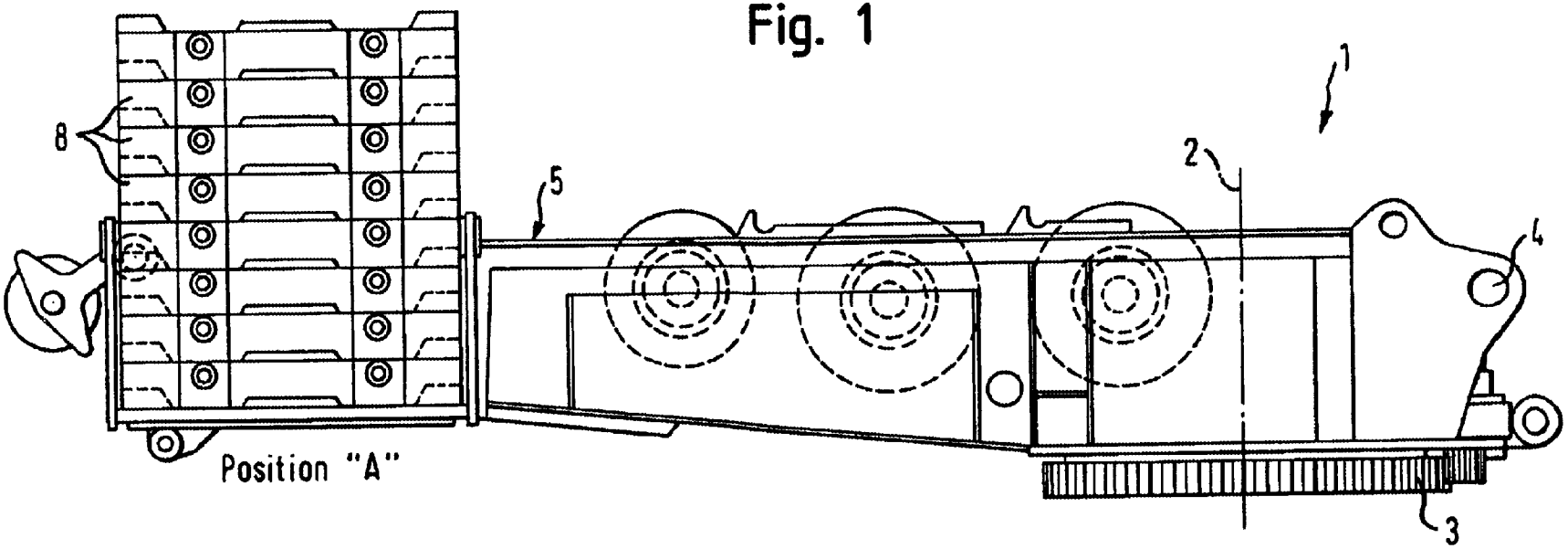
FIG. 1 shows a side view of a rotating deck released from a carrier and having pallets mounted at the sides and bearing stacked counterweight slabs.
Figure 2:
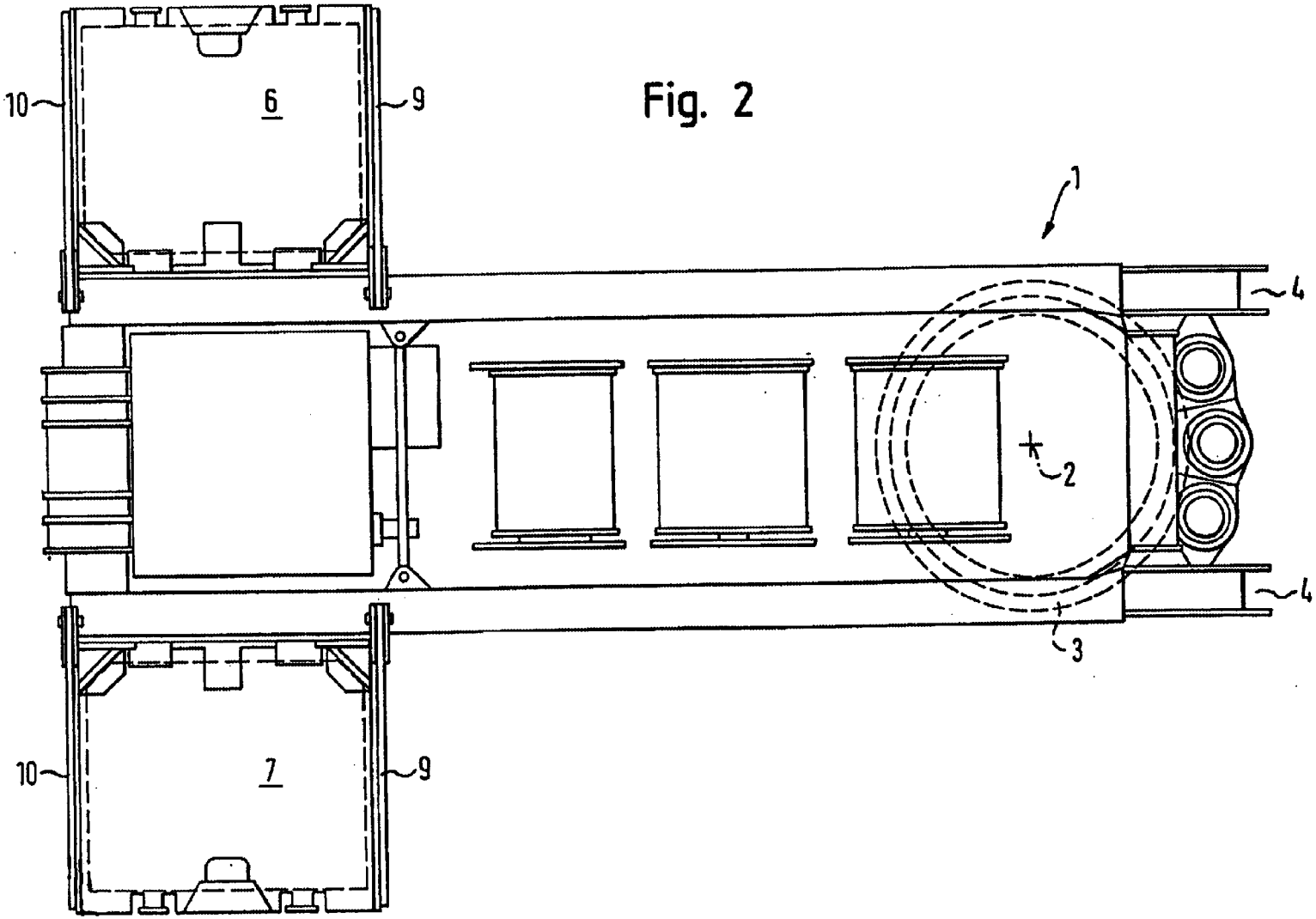
FIG. 2 shows a plan view of the rotating deck in accordance with FIG. 1.
Figure 3:
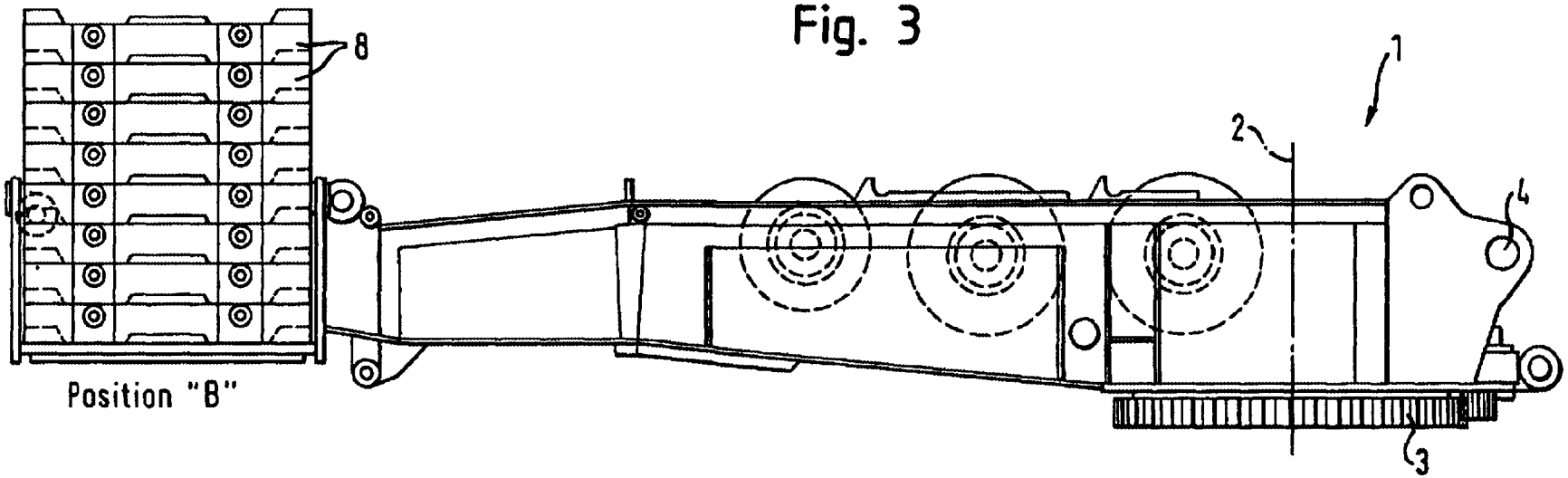
FIG. 3 shows a representation corresponding to FIG. 1 in which a frame is attached to the rear end of the rotating deck, said frame bearing the rear end of the side pallets having the counterweight slabs placed thereon.
Figure 4:
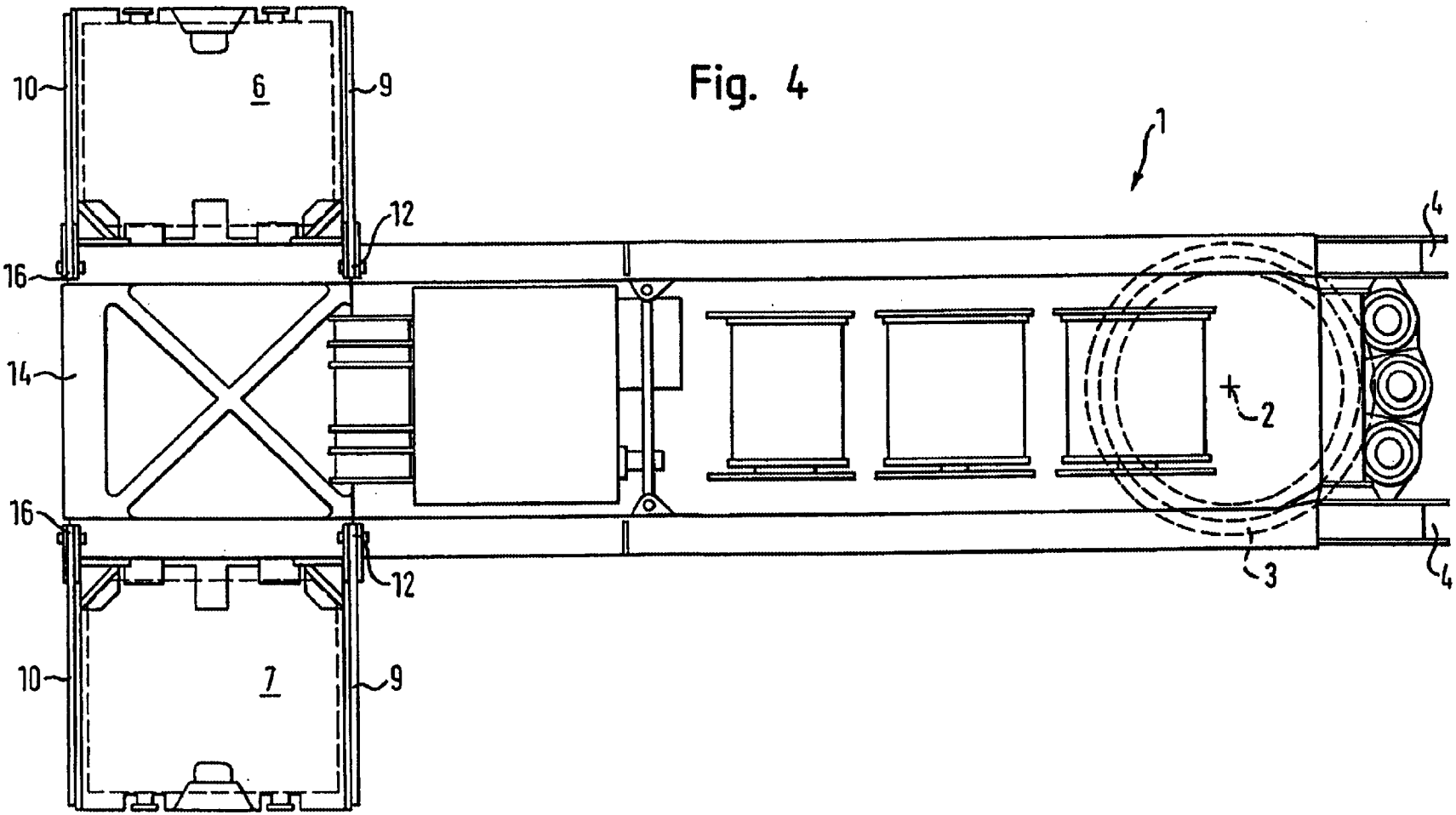
FIG. 4 shows a plan view of the rotating deck in accordance with FIG. 3 and is similar to FIG. 2, except that frame 14 is directly attached to an outer radial end of the deck 1 situated away from the rotating vertical axis 2 and the pallets 6,7 have been moved and positioned radially outwardly from the position shown in FIG. 2.

To extend the lever arm at which the counterweight slabs act, the pallets 6, 7 can be offset to the rear by the attachment of a frame 14 to the rear end of the rotating deck 1 in the manner visible from FIGS. 3 and 4, with the frame 14 approximately corresponding to the width of the slabs and with the frame only being provided with counter-accommodations 12 at its rear end, said counter-accommodations 12 corresponding to the corresponding counter-accommodations of the rotating deck 1. This embodiment allows the inner side walls 9 of the pallets to be connected or hooked to the end counter-accommodations 12 of the rotating deck 1, while the outer side walls 12 of the pallets 6, 7 are connected or hooked in the same way to the identically designed counter-accommodations 16 at the outer end of the frame 14, as before to the side counter-accommodations of the rotating deck.

What is claimed is:

1. A crane vehicle having a carrier and a rotating deck (1) pivotal around a vertical axis (2) thereon and on which a boom swivellable around a horizontal axis is supported, outer end pallets (6, 7) mounted at both sides of the rotating deck (1) and structured and arranged to each receive counterweight slabs (8) stacked on top of one another, and a frame (14) removably attachable directly to an outer radial end of said rotating deck (1) projecting away from said vertical axis (2), said frame (14) being provided with counter-accommodations or couplings (16) at least for respective rear suspension points (11) of said pallets (6, 7) with respect to said vertical axis (2), and said pallets (6,7) each structured and arranged to be attached to said frame (14) on opposite sides from one another and circumferentially with respect to rotation of said deck (1) about said vertical axis (2).

2. A crane vehicle in accordance with claim 1, wherein said frame (14) is provided with two counter-accommodations or couplings (16) for respectively two side suspension points (11) of each said pallet (6, 7).

3. A crane vehicle in accordance with claim 2, wherein said suspension points (11) are constituted by bolt or hook connections (11, 12, 18).

4. A crane vehicle in accordance with claim 3, wherein said pallets (6, 7) are structured and arranged to be coupled to counter-accommodations or couplings (12) of said rotating deck (1) by bolt or hook connections (18) located at a side part of each said pallet (6, 7), and said inner bolt or hook connections (11) of said pallets (6, 7) are structured and arranged to be coupled to said counter-accommodations or couplings (12) of said rotating deck (1) when said frame (14) is attached to said pallets (6, 7) and rotating deck (1).

5. A crane vehicle in accordance with claim 2, wherein said pallets (6, 7) are structured and arranged to be coupled to counter-accommodations or couplings (12) of said rotating deck (1) by bolt or hook connections (18) located at a side part of each said pallet (6, 7), and said inner bolt or hook connections (11) of said pallets (6,7) are structured and arranged to be coupled to said counter-accommodations or couplings (12) of said rotating deck (1) when said frame (14) is attached to said pallets (6, 7) and rotating deck (1).

6. A crane vehicle in accordance with claim 1, wherein said suspension points (11) are constituted by bolt or hook connections (11, 12, 18).

7. A crane vehicle in accordance with claim 6, wherein said pallets (6, 7) are structured and arranged to be coupled to counter-accommodations or couplings (12) of said rotating deck (1) by bolt or hook connections (18) located at a side part of each said pallet (6, 7), and said inner bolt or hook connections (11) of said pallets (6,7) are structured and arranged to be coupled to said counter-accommodations or couplings (12) of said rotating deck (1) when said frame (14) is attached to said pallets (6, 7) and rotating deck (1).

8. A crane vehicle in accordance with claim 1, wherein said pallets (6, 7) are structured and arranged to be coupled to counter-accommodations or couplings (12) of said rotating deck (1) by bolt or hook connections (18) located at a side part of each said pallet (6, 7), and said inner bolt or hook connections (11) of said pallets (6,7) are structured and arranged to be coupled to said counter-accommodations or couplings (12) of said rotating deck (1)when said frame (14) is attached to said pallets (6,7) and rotating deck (1).

9. A crane vehicle in accordance with claim 8, wherein an outer end of said frame (14) with respect to said vertical axis (2) is provided with counter-accommodations or couplings (16) identical to said counter-accommodations or couplings of said rotating deck (1) for coupling to respective connecting devices or suspension points (11) of said pallets (6, 7).

10. A crane vehicle in accordance with claim 1, wherein said frame (14) is provided with said counter-accommodations or couplings (16) for said pallets (6,7) at only a rear outer end thereof with respect to said vertical axis (2) such that inner side walls (9) of said respective pallets (6, 7) can be connected or hooked to outer radial counter-accommodations or couplings (12) of the rotating deck (1) with respect to the vertical axis (2) and outer side walls (10) of the pallets (6,7) with respect to the vertical axis (2) can be connected or hooked to the outer counter-accommodations or couplings (16) of said detachable frame (14).

11. A crane vehicle in accordance with claim 1, wherein, in a first position, said pallets (6,7) are completely attached to the opposite sides of an outer end of the rotating deck (1) with the frame (14) being detached therefrom, and in a second position, said pallets (6,7) are displaced radially outwardly from said first position and being at least partially supported (16) on opposite sides of said frame (14).

* * * * *